United States Patent [19]

Kageyama et al.

[11] 4,448,798

[45] May 15, 1984

[54] COATING METHOD

[75] Inventors: Masahide Kageyama, Tokyo; Takeshi Fujita, Kuki, both of Japan

[73] Assignee: Canon Kabushiki Kaisha, Tokyo, Japan

[21] Appl. No.: 486,076

[22] Filed: Apr. 18, 1983

[30] Foreign Application Priority Data

Apr. 23, 1982 [JP] Japan ..... 57-68507

[51] Int. Cl.[3] ..... G03G 5/082

[52] U.S. Cl. ..... 427/8; 427/430.1; 427/435; 427/74; 430/133; 430/134

[58] Field of Search ..... 427/8, 74, 430.1, 435

[56] References Cited

U.S. PATENT DOCUMENTS 2,860,048 11/1958 Deubner ..... 430/67

*Primary Examiner*—John D. Smith
*Assistant Examiner*—James J. Seidleck
*Attorney, Agent, or Firm*—Fitzpatrick, Cella, Harper & Scinto

[57] ABSTRACT

The present invention comprises a method of coating outside surface of a cylindrical member, with one end being closed and the other end being left open, which comprises dipping said member in a coating material, while holding the same substantially vertically and with the closed end being turned upward, characterized in that detecting the increase in the internal pressure caused by the evaporation of solvent of said coating material in an internal hollow part of said member, and releasing a part of the gas from said internal hollow part to prevent generating bubbles therefrom into the coating material.

3 Claims, 1 Drawing Figure

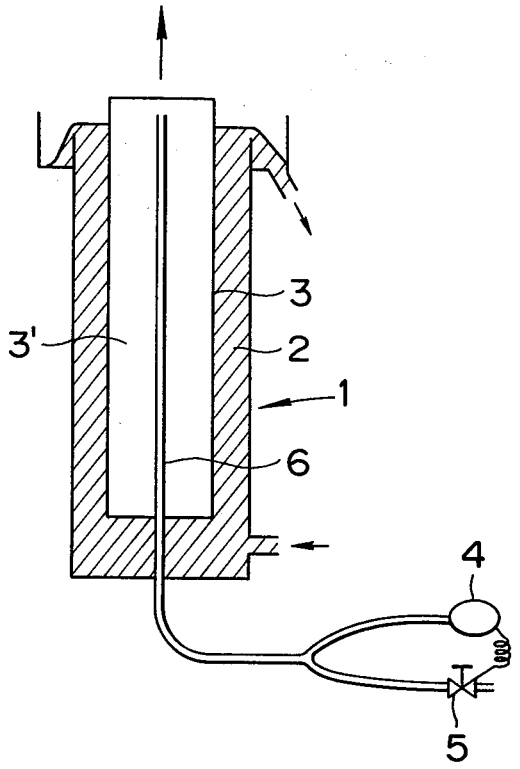
3
3'
2
1
6
4
5

COATING METHOD

BACKGROUND OF THE INVENTION

1. Field of the Invention

The present invention relates to a method for coating a member which is closed at one end and open at the other end.

2. Description of the Prior Art

Resin coating has been widely employed on various articles for the purposes of surface protection, aesthetic feeling or electric shielding. Such coating can be easily formed by coating the article with paint or coating material.

Such coating can be achieved by various methods such as dip coating, spray coating, roller coating, brush coating, and the like, but the dip coating is advantageous for the purpose of forming a uniform coating layer.

Particularly, a cylindrical member closed at the upper end can be conveniently dip coated solely on the external face thereof without intrusion of the coating material into the interior because of the internal pressure inside said member. However, solvents of high vapor pressure are often employed in such a coating material in order to accelerate drying.

In such a coating material, the increase of internal pressure of the cylindrical member resulting from the evaporation of the solvents causes an increase in the amount of gases, whereby the bubbles corresponding to the increase over the internal pressure are pushed out from the cylindrical member during the dip coating process to generate fluctuation in the surface level of the coating material. Such fluctuation in the surface level gives rise to deteriorated uniformity of the coating to be formed on the cylindrical member.

SUMMARY OF THE INVENTION

An object of the present invention is to provide a coating method capable of avoiding the above-described drawback, namely unevenness in the coating layer resulting from the fluctuation in the surface level of the coating material during the coating operation.

Another object of the present invention is to provide a coating method in which the pressure in the hollow part of the member to be coated is detected thereby avoiding the liberation of bubbles from said hollow part into the coating material.

According to the present invention, there is provided a method of coating outside surface of a cylindrical member, with one end being closed and the other end being left open, comprising dipping said member in a coating material, while holding the same substantially vertically and with the closed end being turned upward, which comprises detecting the increase in the internal pressure caused by the evaporation of solvent of said coating material in an internal hollow part of said member, and releasing a part of the gas from said internal hollow part to prevent generating bubbles therefrom into the coating material.

BRIEF DESCRIPTION OF THE DRAWING

The FIGURE illustrated a coating device 1 according to the present invention.

DESCRIPTION OF THE PREFERRED EMBODIMENT

In the coating method of the present invention, the increase in the internal pressure of the internal hollow part of the member closed at the upper end is detected by a pressure sensor, and ejecting means, for example a valve, is opened in such a manner as to avoid releasing of bubbles from said internal hollow part and at the same time to avoid unnecessary intrusion of the coating material into said internal hollow part, thereby effectively preventing the fluctuation in the surface level caused by the formed bubble.

The coating method of the present invention provides for the formation of a highly uniform coating layer solely on the external face of the cylindrical member closed at the upper end, by avoiding the fluctuation in the liquid level caused by the formed bubble formation.

The coating method of the present invention may be applied to a cylindrical member which is closed at one end or open on both ends, and, in the latter case an end is tightly sealed by suitable means before coating.

The present invention may be easily conducted by the use of a pressure sensor and gas ejecting means, and the mutual linkage of the two permits more effective and secure adjustment of the internal pressure in a stable manner, thereby achieving the objects of the present invention in an advantageous manner. As an embodiment of the present invention, an open end of a fine tube is inserted into the uppermost part of the interior of the member to be coated, and the other end of said tube is divided, outside the coating device, into two branches which are respectively equipped with a pressure sensor and a solenoid valve linked with said sensor. Such structure permits exact detection of the internal pressure of the member to be coated and to control the solenoid valve in response to the change in said internal pressure, thereby performing the coating operatin at a constant desirable internal pressure.

In case of coating a large number of members for a long time according to the coating method of the present invention, recirculation of the coating material is advantageous for maintaining a constant formulation of said material, and an overflowing is particularly advantageous in such recirculation.

The member to be coated may be any cylindrical member which is originally or artificially closed at an end as explained before, and the image bearing member used in electrophotography constitutes a representative example of such a cylindrical member. Such an image bearing member is provided on the external surface thereof, with an insulating layer or a photoconductive layer, of which uniformity has a significant influence on the image forming ability, so that such an image bearing member represents an example in which the coating method of the present invention may be most effectively applied.

The image bearing member for forming an electrostatic image or a toner image by an electrophotographic process can be called an electrophotographic photosensitive member having a photoconductive layer, or an image bearing member not provided with such photoconductive member but generally composed of a substrate and an image bearing layer provided thereon.

The electrophotographic photosensitive member may have various structures in order to obtain a determined performance or according to the electrophotographic process to be employed. Representative examples of such a photosensitive member are composed of a substrate and a photoconductive layer formed thereon, or an additional insulating layer formed on said photoconductive layer. The photosensitive member composed of the substrate and the photoconductive layer is employed in a most general electrophotographic process comprising the steps of charging, imagewise exposure and image development eventually followed by an image transfer step. Also, the aforementioned insulating layer is provided for the purpose of protecting the photoconductive layer, improving the mechanical strength of the photosensitive member or the dark delay characteristic or employing particular electrophotographic processes, and the representative examples of such electrophotographic processes employing the photosensitive member with an insulating layer are disclosed for example in the U.S. Pat. No. 2,860,048, Japanese Patent Publication Nos. 16429/1966, 15446/1963, 3713/1971, 23910/1967, 24748/1968, 19747/1967 and 4121/1961. Also there are known image bearing members not provided with a photoconductive layer but only an insulating layer, and the representative examples of the processes utilizing such an image bearing member will be explained in the following.

(1) As disclosed in the Japanese Patent Publication Nos. 7115/1957, 8204/1957 and 1559/1968, such an image bearing member is employed in an electrophotographic process in which the electrostatic image formed on an electrophotographic photosensitive member is transferred, for the purpose of improving the service life thereof, to an image bearing member not provided with the photoconductive layer and developed thereon into a toner image, which is subsequently transferred onto a recording sheet:

(2) Also in certain electrophotographic processes, an electrostatic image is formed on an image bearing member not having a photoconductive layer corresponding to an electrostatic image formed on an electrophotographic photosensitive member. In such an electrophotographic processes, as disclosed in the Japanese Patent Publication Nos. 30320/1970 and 5063/1973 and in the Japanese Patent Laid-open Publication No. 341/1976, an electrostatic image is formed by a determined electrophotographic process on an electrophotographic photosensitive member of a screen-like structure provided with a number of minute apertures, and an image bearing member not having the photoconductive layer is subjected to corona charging through said electrostatic image whereby the ion current is modulated by said electrostatic image to form, on said image bearing member, an electrostatic image, which is subsequently developed into a toner image to be transferred onto a recording sheet.

The electrophotographic photosensitive member having an insulating layer is typically composed of a substrate made for example of steel, stainless steel or aluminum, and a photoconductive layer and an insulating layer laminated thereon.

Said photoconductive layer can be composed of ZnO, CdS, CdSe, $TiO_2$, ZnS, ZnSe, Se, Se-Te, Se-Te-As and the like, or an organic semiconductor such as polyvinyl carbazole and the like employed alone or in combination with a binder resin, and is formed by lamination, vacuum deposition, sputtering, coating and the like, and the thickness of such a photoconductive layer is generally in a range from 5 to 100 microns, preferably in a range of 10 to 50 microns, although said thickness is variable according to the type or characteristic of the photoconductive material to be employed.

Also, said insulating layer is generally made relatively thin to protect the photoconductive layer or to improve the durability or dark decay characteristic, but is made relatively thick in case such an insulating layer is required in certain particular electrophotographic processes.

The thickness of said insulating layer is generally in a range from 5 to 70 microns, preferably in a range from 10 to 50 microns.

The resin used as a binder of the photoconductive layer or as the insulating layer can be ordinary insulating resins such as polyetylene, polyesters, polypropylene, polystyrene, polyvinyl chloride, polyvinyl acetate, acrylic resins, polycarbonate, silicone resins, fluorinated resins or epoxy resins.

Now the present invention will be further explained by the following examples. In the example, parts show values based on weight.

EXAMPLE 1

An aluminum cylinder with an external diameter of 80 mm, a length of 300 mm and a thickness of 3 mm closed at the upper end was used as the member to be coated. The coating material for a first layer was composed of 10 parts of N-methoxymethylated nylon resin dissolved in 70 parts of methanol and 20 parts of toluene. The coating material for a second layer is composed of a dispersion prepared by processing 10 parts of a bisazo pigment of the following chemical formula as the binder, 5 parts of a polyvinyl butyral resin (Esrec BM-1 supplied by Sekisui Chemical), 30 parts of cyclohexanone and 40 parts of methylethylketone for 2 hours in a sand mill containing glass beads of 1 mm in diameter.

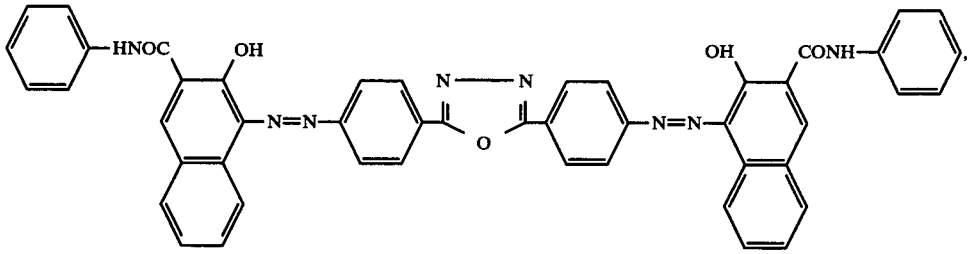

the coating material for a third layer is composed of 10 parts of 1-[pyridyl-(2)]-3-(4-N,N-diethylaminostyryl)-5-(4-N,N-dimethylaminophenyl)pirazoline, 10 parts of a polysulfone resin (Udel-P1700 supplied by VCC) dissolved in 40 parts of monochlorobenzene, 10 parts of toluene and 20 parts of methylethylketone.

These coating materials were applied in a coating device shown in the attached illustration to obtain a first layer of 2 microns, a second layer of 0.2 microns and a third layer of 10 microns, which were respectively dried at 100° C. for 10 minutes. A pressure sensor switch 4 in the FIGURE was Monoster switch MS-60 supplied by Okamura Manuracturing Co., Ltd., Japan.

When the cylindrical member 3 with a diameter of 100 mm and a length of 300 mm was dipped over a length of 280 mm into the coating material 2, the internal pressure was detected by the pressure sensor switch 4 provided on a branch of the fine tube 6 open end of which was inseted into the hollow part 3' of said cylinder 3, and the solenoid valve 5 provided on the other branch of the fine tube 6 was opened in response to the detection of said pressure sensor switch 4 for ejecting a determined amount of gas present in the hollow part of a volume of 78.5 $cm^3$, and the solenoid valve 5 was closed by the pressure sensor switch 4 when the internal pressure reached 270 $mmH_2O$. The cylinder was lifted up at this point, and there was obtained uniform coating without bubble formation.

As a reference example, an identical cylinder was coated with same coating materials under the same coating conditions but without the pressure sensor and the solenoid valve. In this case bubble formation naturally occurred in the course of coating to cause fluctuations in the liquid level, and the obtained coatings showed unevenness or streaks which were visually observable. On the other hand, the photosensitive member prepared according to the present invention hardly showed such defects.

Two samples obtained in the above-described processes were evaluated in an imaging process comprising the steps of (i) charging at 5.7 kV, (ii) imagewise exposure at 25 lux:sec., (iii) image develpment with a magnetic brush, (iv) transfer charging at 5.4 kV, and (v) brush cleaning. The reference sample showed defects on the obtained image corresponding to the defects on the coated surface, but the sample prepared according to the present invention did not show any defect on the obtained image.

What we claim is:

1. A method of coating the outside surface of a cylindrical member, with one end being closed and the other end being open, which comprises:

(1) dipping said member in a coating material, while holding the same substantially vertically and with the closed end being turned upward;

(2) detecting an increase in the internal pressure caused by the evaporation of solvent of said coating material in an internal hollow part of said member; and (3) releasing a part of the gas from said internal hollow part to prevent generating bubbles therefrom into the coating material.

2. A method of coating outside surface of a cylindrical member according to claim 1, wherein a pressure sensor for detecting the increase in the internal pressure in said hollow part and means for releasing a part of internal pressure are operatively associated.

3. A method of coating outside surface of a cylindrical member according to claim 1, wherein said cylindrical member is an image bearing member for use in an electrophotographic device.

* * * * *